US005207330A

United States Patent [19]

Siesco, Jr.

[11] Patent Number: 5,207,330

[45] Date of Patent: May 4, 1993

[54] MAGNETIC PULLEY

[75] Inventor: Leonard E. Siesco, Jr., Fredonia, Wis.

[73] Assignee: Miller Compressing Company, Milwaukee, Wis.

[21] Appl. No.: 786,773

[22] Filed: Nov. 1, 1991

[51] Int. Cl.[5] ..... B03C 1/00

[52] U.S. Cl. ..... 209/219; 209/212

[58] Field of Search ..... 209/212, 219

[56] References Cited

U.S. PATENT DOCUMENTS

| | | | |
|---|---|---|---|
| 2,272,719 | 2/1942 | Maynard | 209/219 |
| 2,989,029 | 6/1961 | Rueger | 209/219 |
| 2,992,733 | 7/1961 | Buus et al. | 209/219 |
| 3,028,708 | 4/1962 | Vaughan et al. | 209/219 X |
| 3,448,857 | 6/1969 | Benson et al. | 209/212 |
| 3,454,913 | 7/1969 | Israelson et al. | 335/306 |
| 4,230,560 | 10/1980 | Nakajima | 209/212 |
| 4,296,865 | 10/1981 | Spodig | 209/219 X |
| 4,834,870 | 5/1989 | Osterberg et al. | 209/212 X |
| 4,869,811 | 9/1989 | Wolanski et al. | 209/212 |
| 5,057,210 | 10/1991 | Julius | 209/212 |
| 5,108,587 | 4/1992 | Walker | 209/212 |

FOREIGN PATENT DOCUMENTS

| | | | |
|---|---|---|---|
| 0342330 | 11/1989 | European Pat. Off. | 209/212 |
| 2917488 | 1/1980 | Fed. Rep. of Germany | 209/219 |
| 0005269 | 1/1979 | Japan | 209/219 |
| 0771090 | 3/1957 | United Kingdom | 209/219 |
| 8907981 | 9/1989 | World Int. Prop. O. | 209/212 |

*Primary Examiner*—Robert P. Olszewski
*Assistant Examiner*—James R. Bidwell
*Attorney, Agent, or Firm*—Foley & Lardner

[57] ABSTRACT

A magnetic repulsion separator for separating a mixture of discrete particles having various electroconductivity characteristics, the separator including a main shaft, a pair of main bearings for supporting the shaft, a hollow rotor mounted on the shaft and having an even number of axially aligned notches around the outer perimeter thereof, a row of permanent magnets in each of the notches, each alternate row of magnets having opposite polarity, an outer nonmagnetic shell mounted for rotary motion on the main shaft and encircling the hollow rotor for carrying the discrete particles of material and a nonmagnetic mesh wrapped around the rows of magnets with a nonmagnetic adhesive provided in the spaces between the rows of the magnets.

5 Claims, 2 Drawing Sheets

MAGNETIC PULLEY

FIELD OF THE INVENTION

The present invention relates to magnetic separators for separating ferrous material from nonferrous materials and more particularly to an improved magnetic pulley which is used to provide the magnetic field for separating the ferrous materials from the nonferrous materials.

BACKGROUND OF THE INVENTION

Magnetic pulleys of the type contemplated herein are used to separate or sort ferrous metal pieces from scrap material travelling on a conveyor belt. Typical separators of this type are disclosed in U.S. Pat. No. 4,869,811, issued to Richard B. Wolanski, et al., on Sep. 26, 1989, entitled "Rotor For Magnetically Sorting Different Materials," U.S. Pat. No. 3,448,857, issued to William H. Benson, et al., on Jun. 10, 1969, entitled "Electrodynamic Separator," and U.S. Pat. No. 3,454,913, issued to Arlo F. Israelson, et al., on Jul. 8, 1969, entitled "Permanent Magnetic Pulley." Each of these patents discloses a magnetic pulley wherein a number of rows of magnets are arranged in spaced relation on the rotor to produce alternating magnetic polarity flux fields.

In the U.S. Pat. No. '857 and U.S. Pat. No. '811 patents, the magnets are mounted on the outer periphery of a cylindrical rotor and held in position by nonmagnetic shells. In the U.S. Pat. No. '913 patent the magnets are shown mounted on an octagon shaped rotor and held in place by a nonmagnetic shell. In each of these patents the magnets are aligned axially with each alternate row of magnets having opposite polarity. In separators of this type a mixture of discrete parts or particles with various electrical conductivity characteristics are projected through an intense unidirectional field with the line of motion of the particles essentially at 90° with the direction of the field, whereby particles of greater conductivity will be decelerated to a greater extent than those of lesser conductivity with the result that different kinds of particles will have different trajectories in emerging from the field and separation of the particles will thereby be achieved.

By rapidly rotating the pulley, a bandlike zone of rapidly reversing high density magnetic flux is produced along the length of the pulley. The pulley is supported horizontally to provide a narrow bandlike area above the pulley, through which the ferrous and nonferrous pieces are moved. As each piece passes through the zone it is momentarily subjected to an alternating magnetic flux which induces an eddy current within the piece. This eddy current in turn produces a repulsive magnetic force in the piece which repels the piece from the zone. By moving the piece through the zone upon a horizontal conveyor which ends at the zone the repulsive force causes the piece to freely continue moving along a trajectory whose length will vary depending upon the strength of the repulsive force. This strength is correlated to the particular type of metal of which the piece is formed, thus the distance which the piece moves away from the zone is proportional to the kind of metal out of which the piece is made, therefore different metals are separated by the distances which the individual pieces travel from the zone.

SUMMARY OF THE PRESENT INVENTION

The present invention relates to an improved magnetic pulley which includes a hollow cylindrical rotor having a number of rows of notches in the outer periphery. A number of permanent magnets are axially aligned in each of the notches in the rotor. The rows of magnets are arranged in end-to-end engagement so that the direction of polarity of each row is radial and thus results in a series of closed loops of flux appearing around the entire periphery of the rotor. The magnets are held in tight engagement by nonmagnetic discs mounted on each end of the rotor which also causes the magnetic flux to stay up on the rotor. A nonmagnetic fabric is wrapped around the magnets to hold the magnets in the notches.

One of the principal features of the invention is the use of notches in the rotor which provides greater stability of the magnets by maintaining the magnets in axial alignment in the notches.

A further feature of the present invention is the provision of a magnetic pulley which does not generate a great deal of heat and therefore does not require cooling.

A still further feature of the invention is the use of nonmagnetic discs at each end of the rotor which causes the magnetic flux to stay in a radial as opposed to an axial direction.

A principal advantage of the invention is provision of a magnet pulley that is easier to assemble and thus more efficient to manufacture.

Other principal features and advantages of the invention will become apparent to those skilled in the art upon review of the following drawings, the detailed description and the appended claims.

Figure 1:
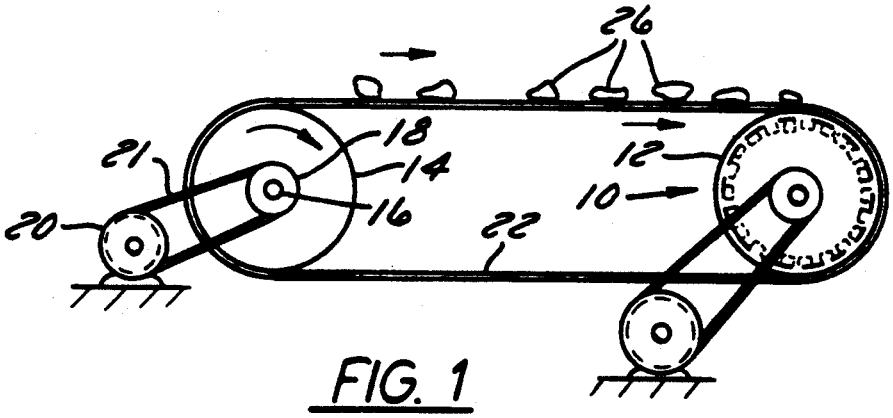
FIG. 1 is schematic view of a typical magnetic sorting conveyor system.
Figure 2:
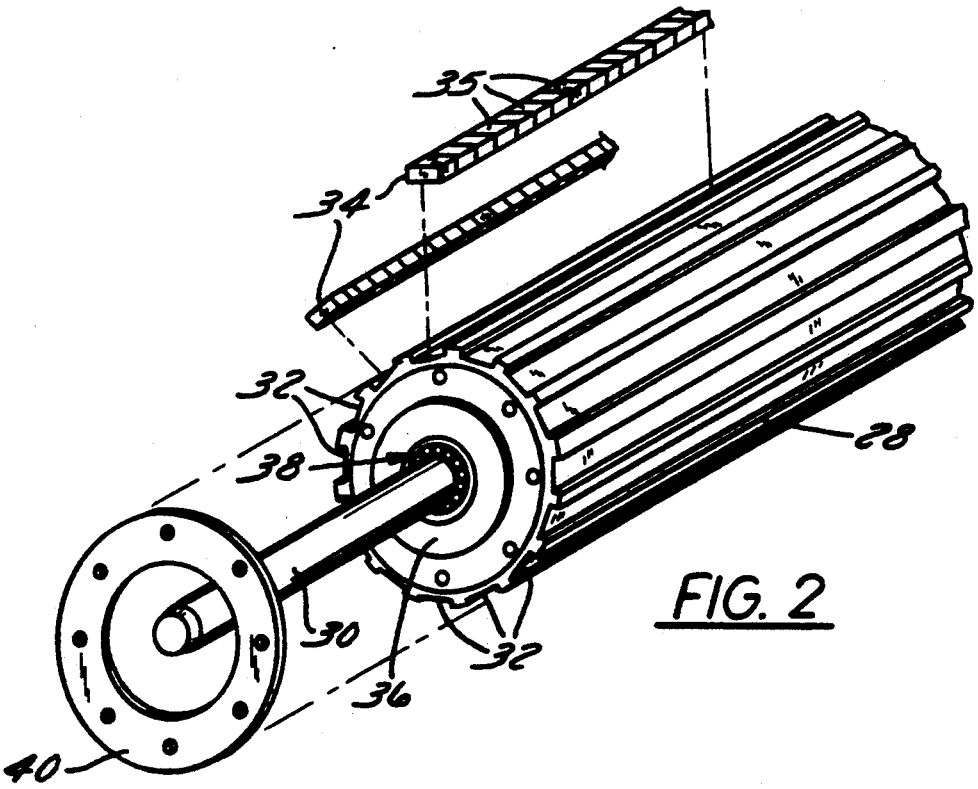
FIG. 2 is an exploded perspective view of the magnetic pulley according to the invention.
Figure 3:
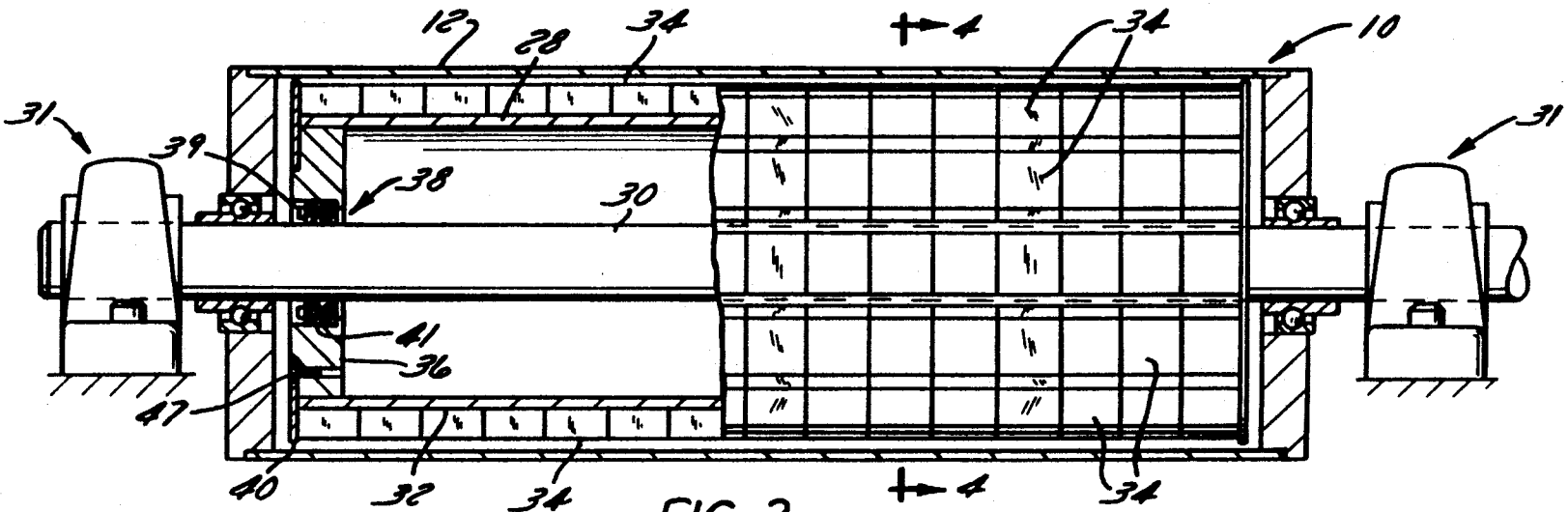
FIG. 3 is a view partly in section of the magnetic pulley.
Figure 4:
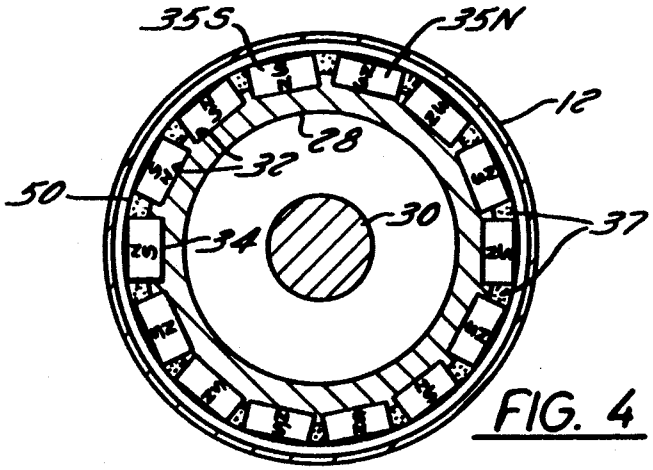
FIG. 4 is a view taken on line 4—4 of FIG. 3.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

Referring to FIG. 1, the magnetic pulley 10 is shown mounted for rotation within a conveyor pulley 12 which is in the form of a thin wall cylinder of nonmagnetic material. A rear pulley 14 is rotatably mounted on a suitable shaft 16 in a spaced relation to the pulley 12. The shaft 16 is provided with a drive pulley 18 which is connected to a variable speed motor 20 by a drive belt 21. A conveyor 22 formed of a nonmagnetic material is supported by the pulleys 12 and 14. The ferrous and nonferrous material 26 is carried by the conveyor belt 22 through the high density magnetic flux produced by the magnetic pulley 10 where the rapidly changing flux field induces an eddy current which in turn produces a repulsive magnetic force in the conductive material. That repulsive force along with the inertia due to the forward movement of the material along the conveyor belt discharges the material forwardly in a downward trajectory. The trajectories of the pieces are proportional to the kinds of metal of which they are formed.

In accordance with the present invention the magnetic pulley 10 includes a hollow rotor 28 made of a low carbon mild steel (10/10) which is supported by a pair of end caps 36 on a shaft 30. The shaft 30 is formed of nonmagnetic material, i.e., stainless steel (304). The end caps 36 are made by a nonmagnetic material and are secured to the shaft by power locks 38. The power locks 38 are of the type having screws 39 for drawing tapered caps 41 into tight engagement with the end cap and shaft. The shaft 30 is mounted for rotation in bearing housings 31.

The rotor 28 is hollow and includes a plurality of notches 32 around the outer periphery for supporting rows of magnets 34. The rotor 28 is hollow to provide a narrow flux path between the rows of magnets causing the flux density to go up to the surface of the rotor rather than into the rotor.

In this regard each row of magnets 34 is made up of a number of magnets 35N and 35S which are formed from a neodymium iron boron material. Each magnet 35 being approximately $2\times2\times1$ inch in size. The magnets 35 are arranged in end-to-end relation in rows 34 with the polarity of each magnet arranged radially, i.e., the north pole of magnets 35N being located outwardly of the rotor and the south pole of the alternate row of magnets 35S being located outwardly of the rotor. The outer ends of each alternate row of permanent magnets thereby being remote from the rotor and of opposite polarity to the outer ends of the adjacent rows of permanent magnets, thus providing alternate poles of north/south polarity.

Means are provided for securing the magnets 35 to the rotor 28. Such means may be in the form of any of a number of commercially available high strength epoxy adhesives. The adhesive is also used to fill the space 37 between the magnets thus providing a nonconductive barrier to the magnetic flux path. The magnets 35N and 35S are secured in the notches 32 by applying a thin layer of the adhesive to the rotor, positioning the magnets 35 in the notches 32 and filling the spaces 37 between the rows of magnets 35 with the adhesive to define a narrow flux path through the rotor.

The magnets 35 are clamped together by means of nonmagnetic end rings 40 which are mounted on the end caps 36 by screws 47 and overlie the outer ends of the rows of magnets 34. The rows of magnets 35 should be maintained in tight engagement with each other to assure that the flux stays up. The end rings 40 are made of a stainless steel (304) and provide a nonmagnetic barrier which causes the magnetic flux to go straight up.

The entire rotor is then wrapped with a plastic mesh reinforced with resin such as Kevlar, a DuPont trademark. The Kevlar is wrapped around the outer perimeter of the magnets 35 up to four times to form a thin nonmagnetic shell 50 which firmly holds the magnets in the notches 32.

Thus, it should be apparent that there has been provided in accordance with the present invention a magnetic pulley that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

I claim:

1. A magnetic pulley comprising a hollow magnetic rotor having a plurality of axially extending notches, a number of magnets mounted in abutting relation in each of said notches on said rotor, the outer end of each alternate row of permanent magnets being of opposite polarity to the outer ends of the adjacent rows of permanent magnets, whereby the magnet fields from said alternate rows of permanent magnets to said adjacent rows of permanent magnets extend radially outwardly from said magnets, a cap on each end of said rotor for supporting said rotor on a shaft and a nonmagnetic side plate mounted on each of said end caps in abutting relation to the ends of each row of said magnets whereby said magnets in each row will be maintained in abutting relation with each other and the magnetic flux at each end of each row of magnets is directed straight up.

2. The pulley according to claim 1 including a nonmagnetic side plate mounted on each of said end caps in abutting relation to the ends of said rotor and said magnets whereby said magnets in each row will be maintained in abutting relation with each other.

3. The pulley according to claim 1 including a nonmagnetic mesh wrapped around said rows of magnets for maintaining said magnets in said notches.

4. A magnetic repulsion separator for separating a mixture of discrete particles having various electroconductivity characteristics, said separator comprising a main shaft, a pair of main bearings for supporting said main shaft, a hollow rotor mounted on said shaft, said rotor including a number of axially aligned notches, a number of rows of permanent magnets mounted in said notches on said rotor, each adjacent row of magnets having opposite polarity, a nonmagnetic barrier abutting each end of the rows of magnets to cause the magnetic flux to stay up, an outer shell mounted for rotary motion on said main shaft and means mounted on said outer shell for carrying discrete particles of material over the main rotor whereby the discrete particles of greater conductivity will be repulsed from the shell a distance greater than the discrete particles of less conductivity.

5. The separator according to claim 4 including a nonmagnetic shell formed from a plastic mesh wrapped around said rows of magnets and a nonmagnetic adhesive provided in the spaces between said rows of magnets.

* * * * *